United States Patent [19]

Langdale

[11] Patent Number: 4,613,997

[45] Date of Patent: Sep. 30, 1986

[54] VERTICAL ACCESS CONVALESCENT BED

[76] Inventor: Oscar E. Langdale, P.O. Box 835, Belle Glade, Fla. 33430

[21] Appl. No.: 620,701

[22] Filed: Jun. 14, 1984

[51] Int. Cl.[4] ..... A61G 7/00

[52] U.S. Cl. ..... 5/62; 5/60; 5/72; 5/202; 180/208

[58] Field of Search ..... 5/62, 60, 61, 175, 202, 5/240, 251, 66–69, 72; 269/323, 324; 180/208; 297/DIG. 4

[56] References Cited

U.S. PATENT DOCUMENTS

| | | | |
|---|---|---|---|
| 2,556,121 | 6/1951 | Thomas | 297/DIG. 4 |
| 3,138,805 | 6/1964 | Piazza | 5/60 |
| 3,149,349 | 9/1964 | Nelson | 5/66 |
| 3,336,606 | 8/1967 | Beitzel | 5/68 |
| 3,434,165 | 3/1969 | Keane | 5/61 |
| 3,736,602 | 6/1973 | Miller | 5/202 |
| 3,818,516 | 6/1974 | Hopper et al. | 5/67 |
| 3,997,926 | 12/1976 | England | 5/62 |
| 4,059,255 | 11/1977 | Perold | 5/62 |
| 4,139,917 | 2/1979 | Fenwick | 5/60 |
| 4,227,269 | 10/1980 | Johnston | 5/68 |

FOREIGN PATENT DOCUMENTS

| | | | |
|---|---|---|---|
| 130409 | 11/1932 | Austria | 5/66 |
| 921562 | 4/1982 | U.S.S.R. | 5/60 |

*Primary Examiner*—Alexander Grosz

*Attorney, Agent, or Firm*—Harvey B. Jacobson

[57] ABSTRACT

A convalescent bed comprises a base frame and a mattress support frame pivotally mounted on the base frame for movement between horizontal and vertical positions. The support frame includes a body portion and a hinged head portion. Power mechanisms are provided for moving the support frame as a unit between the horizontal and vertical positions, and also for swinging the head portion up from the horizontal position independently of the body portion. Further, the bed can be divided longitudinally into two separate sections to facilitate maneuvering same in confined spaces and through narrow openings.

12 Claims, 8 Drawing Figures

VERTICAL ACCESS CONVALESCENT BED

BACKGROUND OF THE INVENTION

This invention relates to a form of bed which is particularly suitable for use by persons who are restricted in the ability to lie down, or who generally need assistance in being lowered into, or raised from a lying position. Beds of this nature which employ powered mechanisms for raising and lowering portions of the bed structure tend, of necessity, to be somewhat heavy and cumbersome. Accordingly, the invention further relates to a bed structure which incorporates means for enhancing the maneuverability thereof so that the bed may be more readily manipulated in and through confined spaces such as narrow passageways, doorways and the like, which may be encountered in hospitals, convalescent homes or like institutions.

STATEMENT OF PRIOR ART

The following U.S. patents show mechanically operated tilting bed structures and the like. None of these, however, discloses a structure having the features of the present invention.

U.S. Pat. No. 2,887,691
U.S. Pat. No. 3,293,667
U.S. Pat. No. 3,609,777
U.S. Pat. No. 3,640,520
U.S. Pat. No. 3,997,926

SUMMARY OF THE INVENTION

In one of its aspects, the invention provides a bed structure comprising a base frame and a tilting mattress support frame pivotally mounted atop the base frame for swinging movements by powered operating means between horizontal and vertical positions, allowing a person to be placed on the bed in a standing position, lowered into a lying position, and again raised, if required, into a standing position. Further, the mattress support frame may include a pivoted head portion with separate powered operating means for raising the head portion from the horizontal position separately from the remainder of the support frame, to enable a person to be raised from a lying position into a semi-reclining position.

An interlock may be provided between the head portion and the remainder of the mattress support frame, preventing the head portion from moving independently when the entire support frame is being raised and lowered, and the operating means for the head portion may require disconnection when the entire support frame is to be tilted. The powered operating means may, for example, comprise electrical or hydraulic jacks or the like.

In another of its aspects, the invention provides a bed structure which can be separated longitudinally into separate halves in order to facilitate manipulation of the bed in confined spaces and through narrow passageways, openings and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
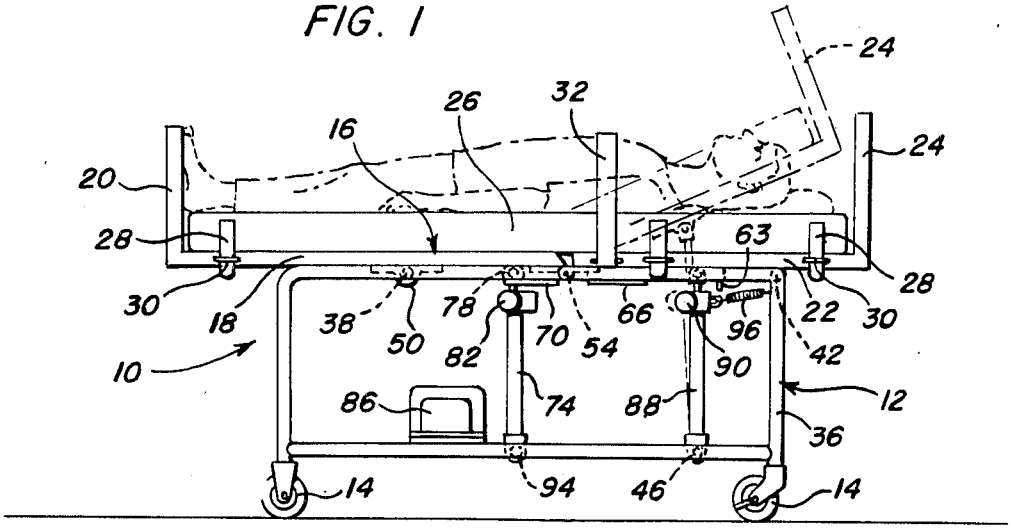
FIG. 1 is a side elevational view of a bed in accordance with the invention, with a mattress support frame shown in lowered position.
Figure 2:
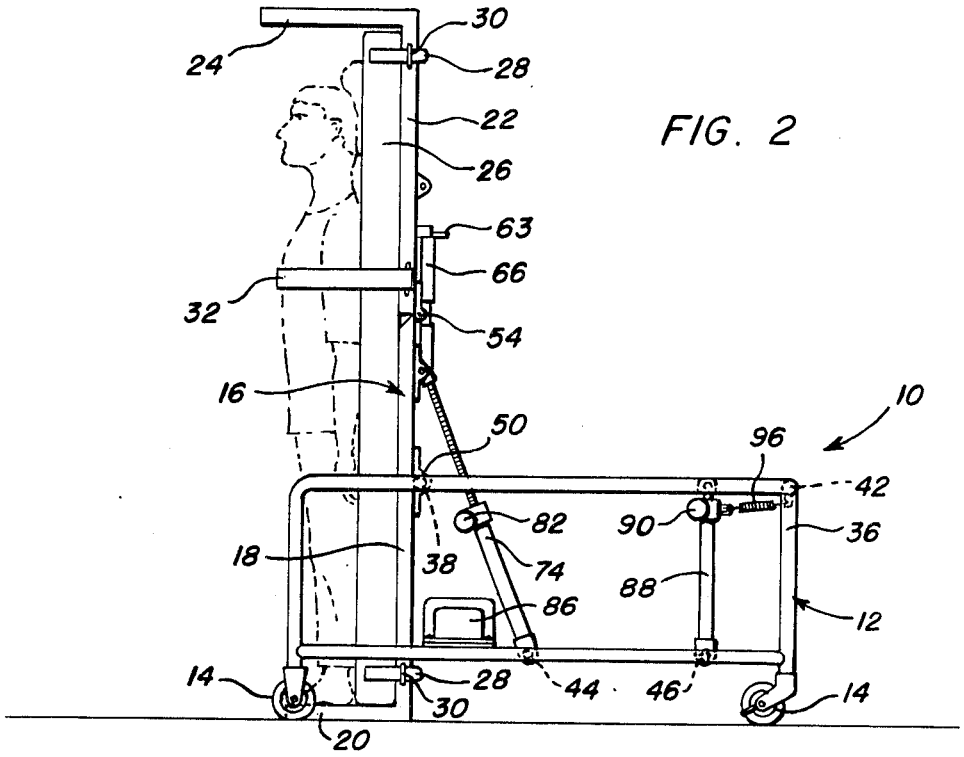
FIG. 2 is a view similar to FIG. 1, with the mattress support frame shown in raised position.

Referring initially to FIGS. 1 and 2 in particular, it will be noted that a bed 10 (which may conveniently be referred to as a convalescent or hospital bed) comprises a base frame 12 on casters 14 (which may be locked and steered in known manner) and a tilting mattress support frame 16 pivotally mounted on the base frame for movement, under the control of powered operating means to be described, between a horizontal position (FIG. 1) and a vertical position (FIG. 2). Further, the mattress support frame is in two parts, namely a body portion 18 incorporating a footboard 20, and a head portion 22, incorporating a headboard 24, the head portion being hinged to the body portion, as will be described, for upward tilting movement to the position shown dotted in FIG. 1, under the control of further powered operating means. The bed includes a mattress 26, which may be secured on the mattress support frame, for example by straps 28 on the mattress which engage in suitable securement loops 30 on the sides of the support frame. Further, there may be provided a releasable patient-securing strap 32 for holding a patient securely on the bed while tilting the support frame between the vertical and horizontal positions. The geometry of the bed is such that in the vertical position of the mattress support frame, footboard 20 just clears the floor, enabling a patient readily to step onto the bed and be lowered into a lying position. Upward tilting of head portion 22 of the support frame allows the patient to be raised from a lying position into a semi-reclining position, for example for reading or eating.

In more detail, base frame 12 may be of welded tubular steel construction, having rectangular side frame portions 34, 36 connected by upper cross-braces 38, 42 and lower cross-braces 44, 46, 48, the foot end of the base frame being clear of cross-braces in order to accommodate the pivoting movements of the mattress support frame. Journal bearings 50, 52 secured to the bottom of portion 18 of the mattress support frame serve pivotally to secure the support frame on upper cross-brace 38. The two support frame portions 18 and 22 are pivotally interconnected by hinges 54, 56, 58, 60. Sliding bolts 62, 64 with handles 63, 65 are provided on the bottom of portion 22 in guides 66, 68 for releasable engagement in keepers 70, 72 on the bottom of portion 18, so as to retain the support frame portions in rigid connection during pivot-ing movements of the frame as a unit about cross-brace 38, and when the frame is in horizontal position, with portion 22 supported on cross-brace 42. For pivoting of portion 22 of the support frame about the hinges, the bolts are released from the keepers. (Support frame 16 is depicted in the drawings as being of a planar, board-like construction. This, however, is by way of illustration only, and the frame may be in the form of a conventional sprung bed frame.)

The powered operating means for raising and lowering support frame 16 about the axis defined by cross-brace 38, is depicted as comprising a pair of electrically operated screw jacks 74, 76 pivotally connected at their lower ends to cross-brace 44 of the base frame, and at their upper ends to pivot pin brackets 78, 80 on the bottom of the support frame. The screw jacks are extended and retracted in known manner by respective electric operating motors 82, 84, and electrical controls for the entire structure may be situated in a control box 86. Limit switches (not shown) may be provided for terminating operation of the screw jack motors when the mattress support frame attains the vertical and horizontal positions respectively.

Figure 6:
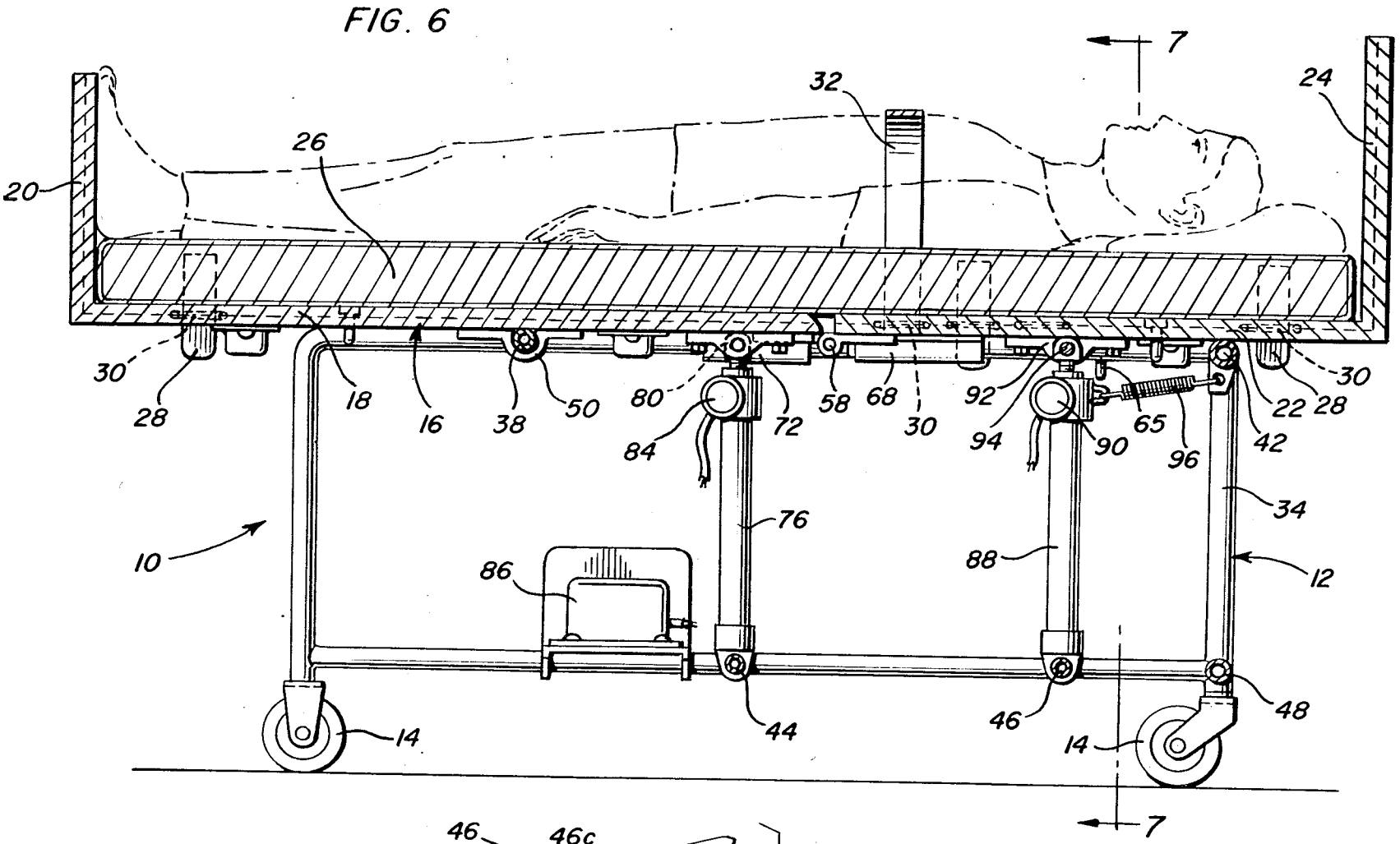
FIG. 6 is an enlarged sectional elevational view of the bed.

The powered operating means for raising and lowering the head portion 22 of frame 16 about hinges 54–60 independently of portion 18 is also depicted as a single electrical screw jack 88 with a drive motor 90, the screw jack being pivotally connected at the bottom to cross-brace 46 of the base frame and having a releasable pivotal connection at its upper end with a bracket 92 on the bottom of head portion 22. Bracket 92 may, for example, include a removable pivot pin 94 (FIG. 6) for connection of the screw jack. By this means, when the mattress support frame is being swung as a unit about brace 38, screw jack 88 can be disconnected and held upright, for example, by a spring 96 connected to the rear of the base frame. When it is desired to elevate the head portion 22 of the support frame from the horizontal position, independently of portion 18, the locking bolts can be released as previously described, screw jack 88 connected with pin 94, and spring 96 released. The electrical controls may also include an interlock which only allows motor 90 to be operated when the support frame is in the horizonal position.

While the powered operating means are depicted herein as comprising electrically operated screw jacks, it will be understood that equivalent powered operating means, such as hydraulic jacks, can also be used.

Figure 4:
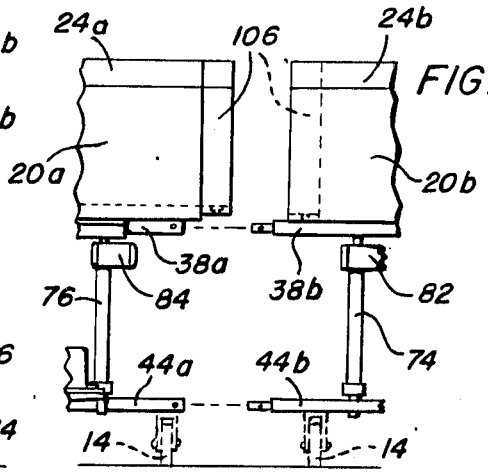
FIG. 4 is a view similar to FIG. 3 showing the bed separated longitudinally into left and right hand sections.
Figure 5:
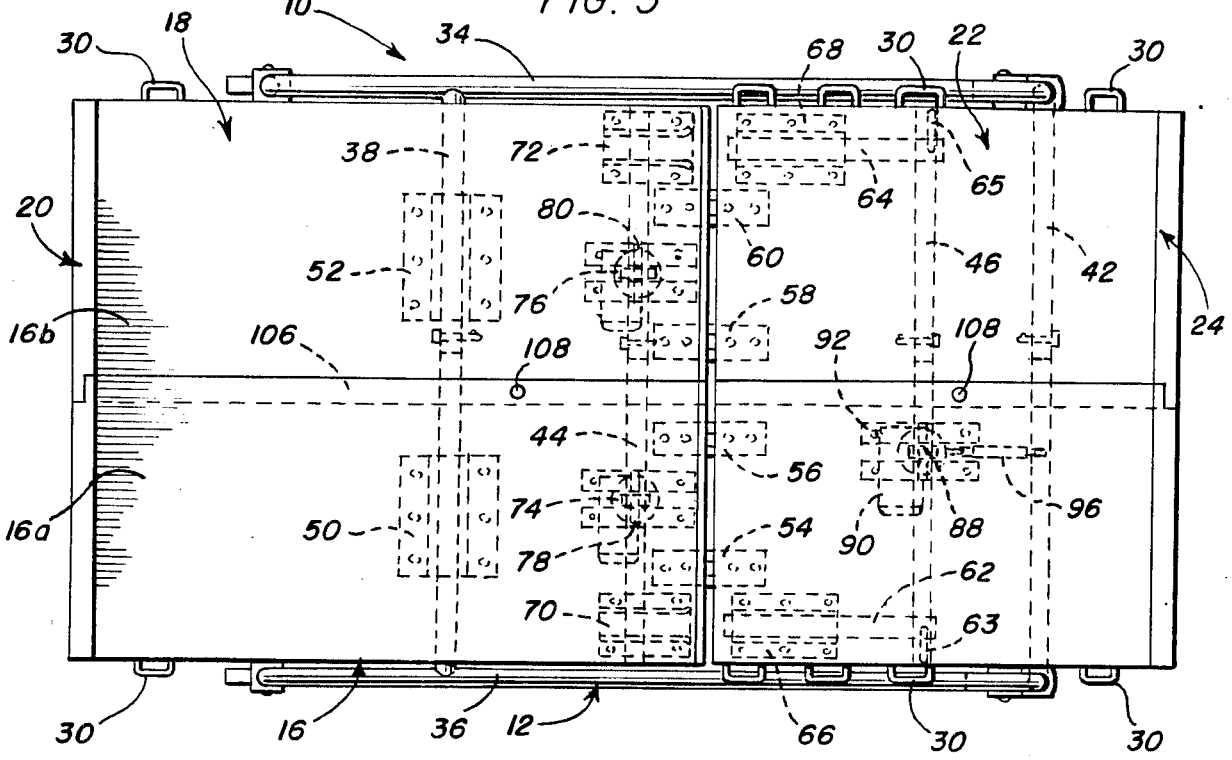
FIG. 5 is an enlarged plan view of the bed with its mattress removed.
Figure 8:
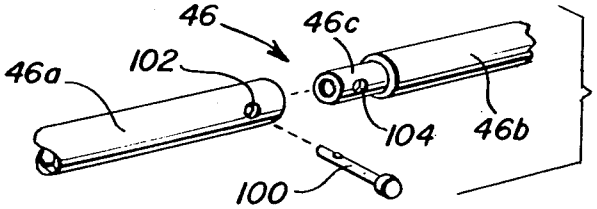
FIG. 8 is an exploded perspective view of parts of the base frame of the bed.

In accordance with a further feature of the invention, the entire bed structure, except for the mattress 26, is adapted to be separated longitudinally into left and right hand sections, as shown in FIG. 4, in order to enhance the maneuverability of the bed, for example, and facilitate its handling in confined spaces or through narrow openings and the like. For this purpose, each of the cross-braces 38–48 of the base frame is formed by two interfitting portions with a central coupling therebetween. For example, as shown in FIG. 8 in detail, each left hand cross-brace portion (as 46*a* in FIG. 8) may be sized to telescopically receive a reduced diameter end portion 46*c* of the right hand cross-brace portion 46*b*, with a connecting pin 100 received in aligned openings 102, 104 of the respective cross-brace portions. It will be appreciated that each of the cross-braces may have a coupling of this nature, but other forms of coupling may also be used.

Figure 3:
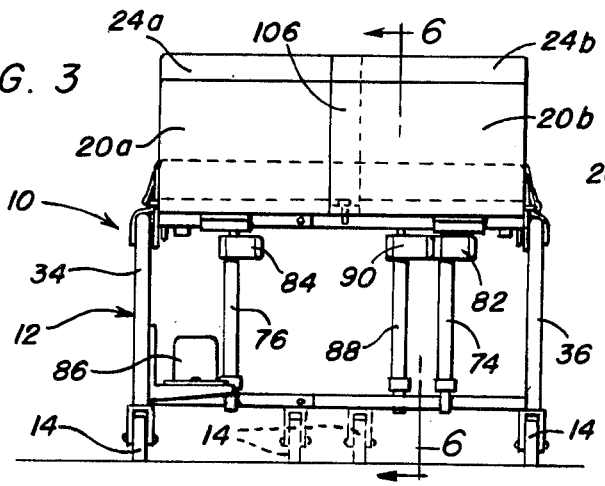
FIG. 3 is an end elevational view of the bed.
Figure 7:
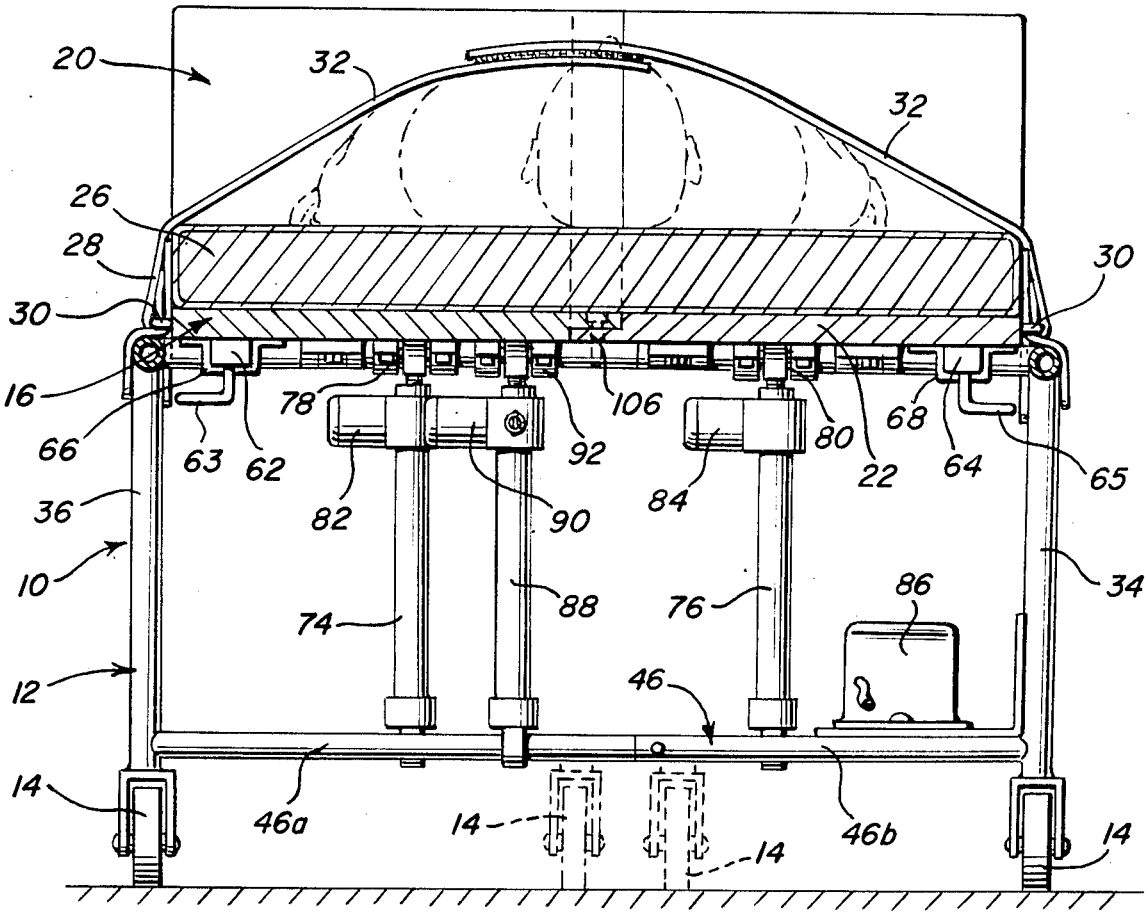
FIG. 7 is a sectional view on line 7—7 of FIG. 6.

Left and right hand sections 16*a* and 16*b* of frame 16 may be interconnected by an overlapping-type joint 106, and releasable connecting pins 108 may be provided between the sections. Each of the left and right hand sections of the bed may be provided with casters 14 at its four corners to aid in maneuverability, although this is not essential, and the central casters are only shown in phantom in FIGS. 3, 4 and 7. It will be noted that all of the operational components of the bed, such as the screw jacks, journal bearings, hinges, and locking bolts are positioned respectively on opposite sides of the longitudinal line of division of the two bed sections. Also, electrical wiring from control box 86 to the electrical components on the other section of the bed may include suitable plug and socket connections allowing separation of the bed sections. (In an alternative embodiment, the mattress support frame may disconnect from the bed frame for longitudinal separation of the latter.)

It will be seen from the foregoing that the invention provides an improved form of bed structure for use by convalescents, invalids, and the like which provides the facility for a person to step onto the bed, for being lowered into lying position, for being elevated mechanically from a lying position to a semi-reclining position, and to a standing position, the bed also having improved maneuverability due to the longitudinal separation facility.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bed structure comprising a base frame, a mattress support frame, pivotal connection means mounting the mattress support frame on the base frame for swinging movement of the support frame between a horizontal position on the base frame and a vertical position allowing a person to step onto the support frame for lowering the person into a lying position, first powered operating means connected between the base frame and the mattress support frame for moving the support frame between the vertical and horizontal positions, the mattress support frame including pivotally interconnected body and head portions, and the structure including further powered operating means on the base frame for swinging the head portion of the support frame upwardly from the horizontal position independently of the body portion of the support frame, the structure further including means for providing a releasable connection between the further powered operating means and the head portion of the mattress support frame so that the further powered operating means can be released from the support frame for movement of the support frame as a whole between the vertical and horizontal positions by the first powered operating means, and the support frame including means for holding the body and head portions in rigid alignment during movement of the support frame as a whole between the vertical and horizontal positions.

2. The invention of claim 1 wherein the powered operating means comprises at least one extendable and retractable jack pivotally interconnected at its respective ends to the base frame and the mattress support frame.

3. The invention of claim 1 including means for separating the base frame longitudinally into separate sections to facilitate maneuvering same through confined spaces.

4. The invention of claim 3 wherein the base frame comprises side frames and cross-braces, and the separating means comprises a releasable coupling in each cross-brace.

5. The invention of claim 3 including means for separating the mattress support frame longitudinally into separate sections.

6. The invention of claim 1 including releasable strap means associated with the mattress support frame for holding a person during movement of the support frame between the horizontal and vertical positions.

7. A bed structure comprising a base frame, a mattress support frame, pivotal connection means mounting the mattress support frame on the base frame for swinging movement of the support frame between a horizontal position on the base frame and a vertical position allowing a person to step onto the support frame for lowering the person into a lying position, powered operating means connected between the base frame and the mattress support frame for moving the support frame between the vertical and horizontal positions, the mattress support frame including pivotally interconnected body and head portions, and the structure including further powered operating means on the base frame for swinging the head portion of the support frame upwardly from the horizontal position independently of the body portion of the support frame, wherein the pivotal connection means mounts the body of the mattress support frame on the base frame, and wherein the further powered operating means comprises an extensible and retractable jack means having a releasable connection with the head portion of the mattress support frame, so that the further powered operating means can be released from the support frame during movement of the support frame as a unit between the vertical and horizontal position, wherein the body portion and head portion of the mattress support frame are pivotally interconnected by hinge means, and the support frame includes means for holding the portions in rigid alignment preventing downward tilting of the head portion during movement of the support frame as a unit between the vertical and horizontal position, wherein the holding means comprises elongate rigid means for bridging the hinge means.

8. The invention of claim 7 wherein the elongate means comprises retractable bolts.

9. A bed structure including a base frame and means for separating the base frame longitudinally into separate sections to enhance the maneuverability thereof in confined spaces and the like, wherein the structure includes a mattress support frame on the base frame, wherein the mattress support frame is pivotally mounted on the base frame for swinging movements between horizontal and vertical positions, and the structure includes powered operating means for effecting such movements, and wherein the mattress support frame comprises a body portion and a head portion hinged to the body portion for upward swinging movement independently of the body portion only when the support frame is in horizontal position, the structure including further powered operating means for providing such movement of the head portion.

10. The invention of claim 9 including casters at the corners of each section.

11. The invention of claim 10 wherein the base frame comprises side members and cross-braces, and the separating means comprises couplings in the respective cross-braces.

12. The invention of claim 9 wherein the structure includes means for separating the mattress support frame longitudinally into sections.

* * * * *